US007848680B2

(12) United States Patent
Takahashi et al.

(10) Patent No.: US 7,848,680 B2
(45) Date of Patent: Dec. 7, 2010

(54) IMAGE FORMING APPARATUS AND TONER COLLECTION METHOD

(75) Inventors: Masashi Takahashi, Kanagawa-ken (JP); Minoru Yoshida, Tokyo (JP); Takeshi Watanabe, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1002 days.

(21) Appl. No.: 11/621,810

(22) Filed: Jan. 10, 2007

(65) Prior Publication Data

US 2008/0166152 A1 Jul. 10, 2008

(51) Int. Cl.
*G03G 15/30* (2006.01)

(52) U.S. Cl. ..... 399/149; 399/227

(58) Field of Classification Search ..... 399/149, 399/227

See application file for complete search history.

(56) References Cited

U.S. PATENT DOCUMENTS 4,707,108 A * 11/1987 Akio ..... 399/227
5,073,800 A * 12/1991 Yamaguchi et al. ..... 399/150
6,625,414 B2 9/2003 Izumi
2004/0228656 A1* 11/2004 Kamimura ..... 399/149
2006/0002750 A1* 1/2006 Ono ..... 399/359

FOREIGN PATENT DOCUMENTS

| | | |
|---|---|---|
| JP | 60-214377 | 10/1985 |
| JP | 64-050089 | 2/1989 |
| JP | 05-341643 | 12/1993 |
| JP | 06-110343 | 4/1994 |
| JP | 08328344 A * | 12/1996 |
| JP | 11-249452 | 9/1999 |
| JP | 2000-181169 | 6/2000 |
| JP | 2003-307905 | 10/2003 |

OTHER PUBLICATIONS

Machine Translation JP 08328344.*
English Abstract JP 08328344.*

* cited by examiner

*Primary Examiner*—David P Porta
*Assistant Examiner*—Bryan P Ready
(74) *Attorney, Agent, or Firm*—Turocy & Watson, LLP

(57) ABSTRACT

There is provided a technique in which in a four-rotation intermediate transfer system image forming apparatus, even in a state where a large amount of transfer residual toner is generated, the occurrence of color mixture of toners can be effectively suppressed.

20 Claims, 9 Drawing Sheets

IMAGE FORMING APPARATUS AND TONER COLLECTION METHOD

BACKGROUND OF THE INVENTION

1. Field of the Invention

The present invention relates to an image forming apparatus of a cleanerless process in which a toner image is formed on an image bearing body by a developing device and a toner remaining on the image bearing body is collected by the developing device, and particularly to an improvement in picture quality and an increase in efficiency of toner recycle.

2. Description of the Related Art

Hitherto, there is known an image forming apparatus adopting an intermediate transfer system in which toner images of four colors are transferred onto an intermediate transfer body, and the toner images of the four colors transferred on the intermediate transfer body are collectively transferred onto a transfer member such as a sheet.

Among the intermediate transfer system image forming apparatuses as stated above, there is known one adopting a so-called four-rotation intermediate transfer system in which toner images are formed on one image bearing body by plural developing devices disposed in the circumferential direction, the transfer of the toner image formed on the image bearing body onto the intermediate transfer body is repeated four cycles, and the toner images of four colors transferred on the intermediate transfer body are collectively transferred onto a transfer member such as a sheet.

In the structure adopting the four-rotation intermediate transfer system as stated above, the plural color developing devices are changed over at the time of formation of the respective color images and the changed one comes in contact with the one photoconductor. Accordingly, when the development of the first color is ended at the time of image formation of the first color, the developing device of the second color immediately comes in contact with the photoconductor, and the development of the second color is started. On the other hand, the transfer of the first color is ended and when the residual transfer toner reaches the next development portion, the developing device of the second color is in contact, and when development simultaneous cleaning is performed in the cleanerless process, the residual transfer toner of the first color is mixed into the developing device of the second color, and there arises a problem of color mixture.

For example, at the time of transfer of a yellow toner image from the photoconductor to the intermediate transfer body, yellow transfer residual toner is generated on the photoconductor. However, in the four-rotation type color image forming apparatus, before the yellow transfer residual toner is sent to the development position by the rotation of the photoconductor, the developing device is changed from the yellow developing device to the next magenta developing device by the rotation of a rotator. Thus, the yellow transfer residual toner on the photoconductor is collected into the magenta developing device, and there occurs a disadvantage that the magenta toner and the yellow toner are mixed.

In order to eliminate this disadvantage, there is proposed a method of using a collection apparatus in which plural collection units to collect transfer residual toner are disposed around a photoconductor, or plural collection units are substantially cylindrically arranged together on a rotation member, and the collection units are sequentially made opposite to the photoconductor by the rotation of the rotation member to collect the residual toner (see, for example, JP-A-9-23696).

Besides, in a four-rotation intermediate transfer system image forming apparatus, there is disclosed a technique in which development rollers coming in contact with a photoconductor and collection units are included, and collected toners are returned to the developing devices of the same colors (see, for example, U.S. Pat. No. 6,625,414B2). In these techniques, as the collection of the transfer residual toner by the collection unit proceeds, the transfer residual toner is accumulated in the collection unit. Since the amount of toner which can be collected by the collection unit is restricted to a certain degree by the restriction of an arrangement space and the like, there is a fear that in a state where the amount of transfer residual toner becomes very large, the amount of transfer residual toner to be collected exceeds the collection capacity of the collection unit. In the case where the amount of transfer residual toner exceeds the collection capacity of the collection unit, the transfer residual toner which could not be collected remains on the photoconductor, and the color mixture of toners is caused.

SUMMARY OF THE INVENTION

It is an object of an embodiment of the present invention to provide a technique in which in a four-rotation intermediate transfer system image forming apparatus, even in a state where a large amount of transfer residual toner is generated, the occurrence of color mixture of toners can be effectively suppressed.

In order to solve the foregoing problem, an image forming apparatus according to an aspect of the invention is an image forming apparatus of a cleanerless process in which a toner image is formed on an image bearing body by a developing device and a toner remaining on the image bearing body is collected by the developing device, and includes a development unit to movably hold plural developing devices to form images with toners of colors different from each other and to move a desired developing device to a specified development position opposite to the image bearing body by the movement, a collection unit capable of changing a mode between a collection mode of collecting the toner remaining on the image bearing body at a specified collection position of the image bearing body and a non-collection mode of not performing toner collection from the image bearing body, and a control unit to set, when a first developing device is changed to a second developing device in the development unit, the collection unit into the collection mode only in a specified period within a period from a second timing earlier than a first timing when the first developing device is changed to the second developing device by a time required for an image bearing surface of the image bearing body to move from the specified collection position to the specified development position to a third timing when a rear end of an area where the toner image is formed by the first developing device before the second developing device on the image bearing body reaches the specified collection position.

Besides, an image forming apparatus according to another aspect of the invention is an image forming apparatus of a cleanerless process in which a toner image is formed on an image bearing body by a developing device and a toner remaining on the image bearing body is collected by the developing device, and includes a development unit to movably hold plural developing devices to form images with toners of colors different from each other and to move a desired developing device to a specified development position opposite to the image bearing body by the movement, collection means capable of changing a mode between a collection mode of collecting the toner remaining on the image bearing body at a specified collection position of the image bearing body and a non-collection mode of not performing toner collection from the image bearing body, and control means for setting, when a first developing device is changed to a second developing device in the development unit, the collection means into the collection mode only in a specified period within a period from a second timing earlier than a first timing when the first developing device is changed to the second developing device by a time required for an image bearing surface of the image bearing body to move from the specified collection position to the specified development position to a third timing when a rear end of an area where the toner image is formed by the first developing device before the second developing device on the image bearing body reaches the specified collection position.

Besides, a toner collection method according to another aspect of the invention is a toner collection method in an image forming apparatus of a cleanerless process in which a toner image is formed on an image bearing body by a developing device and a toner remaining on the image bearing body is collected by the developing device, and when a first developing device is changed to a second developing device in a development unit to movably hold plural developing devices to form images with toners of colors different from each other and to move a desired developing device to a specified development position opposite to the image bearing body by the movement, toner collection is performed by a collection unit, which can collect a toner remaining on the image bearing body at a specified collection position of the image bearing body, only in a specified period within a period from a second timing earlier than a first timing when the first developing device is changed to the second developing device by a time required for an image bearing surface of the image bearing body to move from the specified collection position to the specified development position to a third timing when a rear end of an area where the toner image is formed by the first developing device before the second developing device on the image bearing body reaches the specified collection position.

DESCRIPTION OF THE EMBODIMENTS

Hereinafter, embodiments of the invention will be described with reference to the drawings.

First Embodiment

Figure 1:
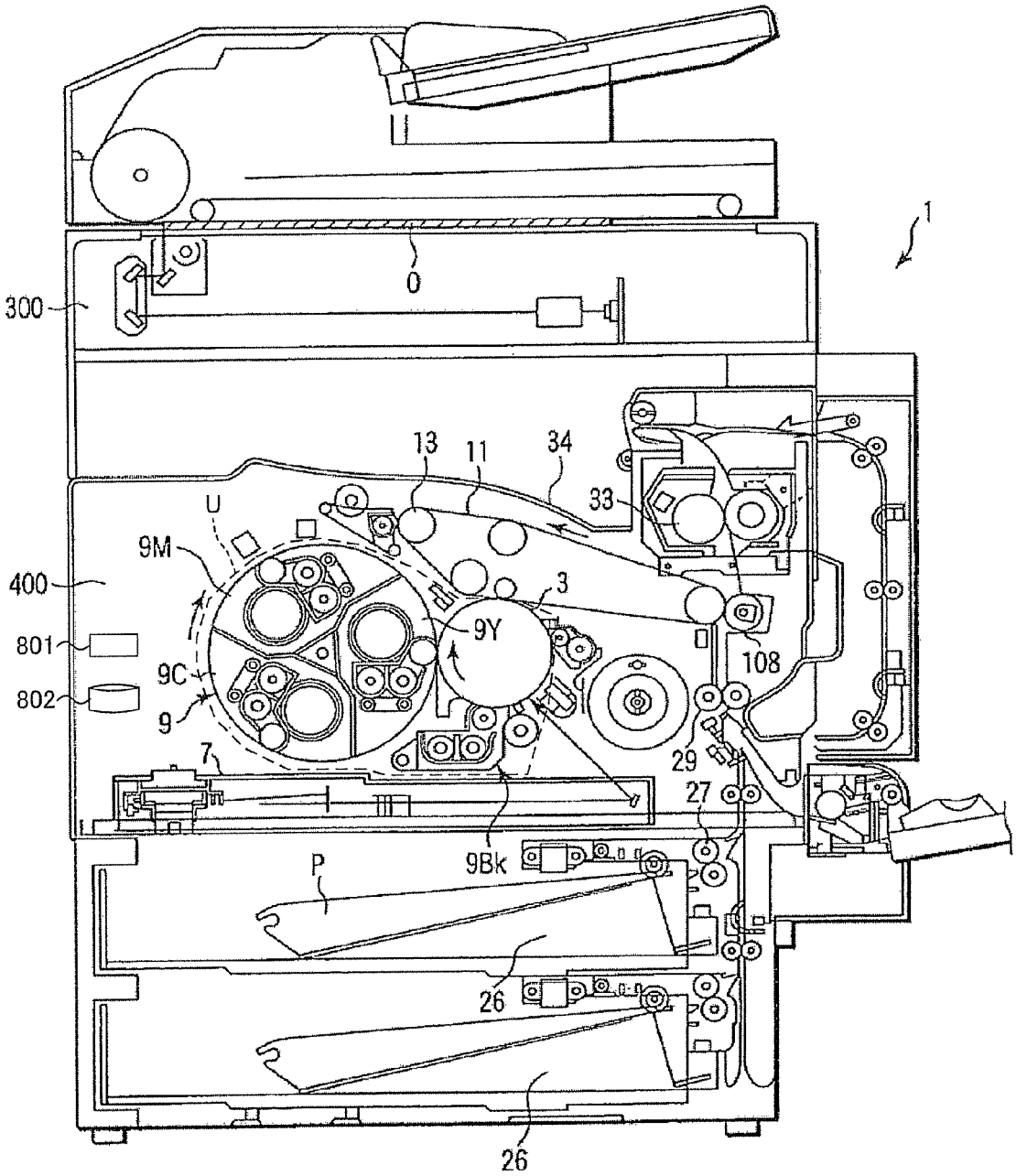
FIG. 1 is a sectional view showing a color image forming apparatus according to an embodiment including a four-rotation type image bearing body in which a color developing device and a monochrome developing device are separately disposed.

First, a first embodiment of the invention will be described. FIG. 1 is a sectional view showing a color image forming apparatus according to this embodiment including a four-rotation type image bearing body in which a color developing device and a monochrome developing device are separately disposed. In FIG. 1, an image forming apparatus 1 according to this embodiment includes a photoconductive drum 3 as the image bearing body, and this photoconductive drum 3 is rotated four times so that a color developer image is formed on a sheet. The image forming apparatus 1 according to this embodiment adopts a cleanerless process in which a toner image is formed on the photoconductive drum 3 by a developing device, and a toner remaining on the photoconductive drum 3 is collected by the developing device.

Figure 2:
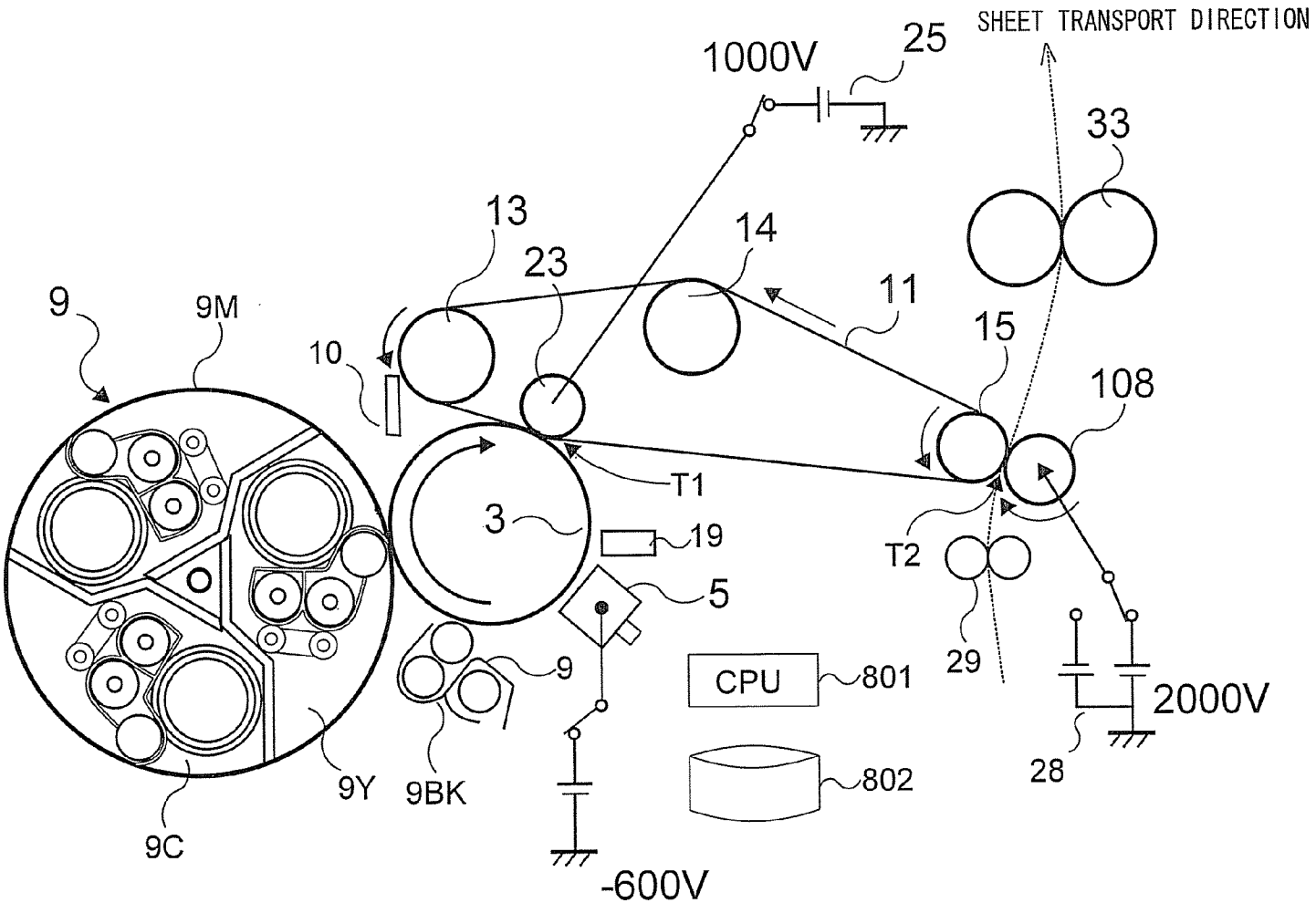
FIG. 2 is an enlarged detailed view showing the details of an image forming process portion.

FIG. 2 is an enlarged detailed view showing the details of an image forming process portion. Hereinafter, the details of an image forming process will be described by use of FIG. 2. The photoconductive drum 3 has a cylindrical shape of a diameter of 100 mm and is supported to be rotatable in an illustrated arrow direction. The following are disposed around the photoconductive drum 3 along the rotation direction. First, a charging charger 5 is provided to be opposite to the surface of the photoconductive drum 3. This charging charger 5 uniformly negatively (−) charges the photoconductive surface of the photoconductive drum 3. Of course, instead of the charging charger, contact charging by a conductive roller, a brush, a blade or the like is also possible.

An exposure position where the charged photoconductive drum 3 is exposed by an exposure device 7 to form an electrostatic latent image is set at the downstream side (lower part in FIG. 1) of the charging charger 5. A developing device 9Bk (black development unit, collection unit, collection means) which uses a black developer to reversely develop the electrostatic latent image formed by the exposure device 7 is provided at the downstream side of the exposure position of the exposure device 7. Besides, a rotation development unit which rotatably and movably holds plural color developing devices 9C, 9M and 9Y to form images with toners of colors different from each other, that is, yellow, magenta and cyan, with respect to the photoconductive drum 3 and moves a desired developing device to a specified development position opposite to the photoconductive drum 3 by the rotation and movement is disposed at the downstream side of the developing device 9Bk. Besides, in this embodiment, the capacity of the black developing device is set to be larger than the capacity of each of the color developing devices 9C, 9M and 9Y.

Further, an intermediate transfer belt 11 having a belt surface onto which the color toner image formed on the photoconductor is transferred (primary transfer) in a primary transfer area T1 and holding the color toner image on the belt surface is disposed at the downstream side thereof. The photoconductive drum 3 is rotated four times and when the color toner images are transferred on the intermediate transfer belt 11, the developer images transferred on the intermediate transfer belt 11 are collectively transferred onto a transported sheet in a secondary transfer area T2. An antistatic lamp 19 is provided at the downstream side of the contact position between the photoconductive drum 3 and the intermediate transfer belt 11. The antistatic lamp 19 eliminates the surface charge on the photoconductive drum 3 by uniform light irradiation after the transfer. One cycle of the image formation is completed by the charge elimination by this antistatic lamp 19, and in the next image forming process, the charging charger 5 again uniformly charges the non-charged photoconductive drum 3. This process is repeated four times, so that the color toner images of the four colors of yellow, magenta, cyan and black are formed on the intermediate transfer belt. The intermediate transfer belt 11 has a shape of an endless (seamless) belt, and is supported on a driving roller 15 to rotate the intermediate transfer belt at a specified speed, a driven roller 13, and a tension roller 14 to apply tension to the belt. The driving roller 15 and the driven roller 13 are respectively provided to be rotatable in an illustrated arrow direction. The intermediate transfer belt 11 is rotated in accordance with the rotation of the driving roller 15, and the driven roller 13 is driven-rotated.

A cleaning device 10 which can come in contact with and be separated from the belt surface of the intermediate transfer belt 11 is disposed around the intermediate transfer belt 11. The cleaning device 10 is a rubber blade or a brush. In a period in which the color toner image is primarily transferred on the intermediate transfer belt 11, the cleaning device 10 is separate from the intermediate transfer belt 11. After the color toner images are secondarily transferred onto the sheet, the cleaning device 10 cleans the belt surface of the intermediate transfer belt 11.

A secondary transfer roller 108 is disposed at a position opposite to the driving roller 15. The secondary transfer roller 108 can perform the operation of contact and separation with respect to the intermediate transfer belt 11, and is separate from the intermediate transfer belt 11 in a period when the color image is primarily transferred on the intermediate transfer belt 11. After the color images of the four colors are formed on the intermediate transfer belt 11, the secondary transfer roller 108 comes in contact with the intermediate transfer belt 11, forms the secondary transfer area T2, and collectively secondarily transfers the color toner images born on the intermediate transfer belt 11 onto the transported sheet P.

In the vicinity of the contact position between the intermediate transfer belt 11 and the photoconductive drum, a transfer device 23 as primary transfer means is provided to be opposite to the photoconductive drum. That is, the transfer device 23 is provided above the opposite photoconductive drum 3, is in contact with the back of the intermediate transfer belt 11, and is opposite to the photoconductive drum 3 through the intermediate transfer belt 11.

The transfer device 23 is a conductive urethane foam roller which is made conductive by dispersion of carbon. The roller with an outer diameter of 418 mm is formed on a cored bar of 410 mm. A positive (+) constant voltage DC power source 25 as voltage application means is connected to the cored bar.

A power feeding device in the transfer device 23 is not limited to the roller, but may be a conductive brush, a conductive rubber blade, a conductive sheet or the like.

In FIG. 1, a paper feed cassette 26 to contain sheets P is provided at a lower part of the image forming apparatus 1. A pickup roller 27 to pick up the sheets P from the paper feed cassette 26 one by one is provided in the main body of the image forming apparatus. A register roller pair 29 is rotatably provided between the pickup roller 27 and the intermediate transfer belt 11. The resist roller pair 29 supplies the sheet P at a specified timing to the secondary transfer part where the intermediate transfer belt and the secondary transfer roller are opposite to each other.

Besides, in FIG. 1, a fixing unit 33 to fix the developer onto the sheet P and a paper discharge tray 34 to which the sheet P fixed by the fixing unit 33 is discharged are provided above the secondary transfer part.

A CPU (corresponding to a control unit) 801 serves to perform various processings in the image forming apparatus 1 and also serves to realize various functions by executing programs stored in a MEMORY 802. The MEMORY 802 includes, for example, a ROM, a RAM or the like, and serves to store various information and programs used in the image forming apparatus 1.

In a process unit U, the photoconductive drum 3 and at least one of the black toner developing device 9Bk (corresponding to the collection unit) and the rotation development unit are integrally supported, and are attachable to and detachable from the main body of the image forming apparatus 1. As shown in FIG. 1, in this embodiment, as an example, the process unit U includes the rotation development unit, the photoconductive drum 3 and the black toner developing device 9Bk. Of course, the structure of the process unit U can also be made such a structure as to include portions other than the photoconductive drum and the developing device according to the restriction of space in the image forming apparatus, the arrangement of parts and the like.

Next, a color image forming process in the image forming apparatus structured as described above will be described. When an image forming processing start is instructed through a not-shown operation panel (Control panel) located at the front of the image forming apparatus 1, the photoconductive drum 3 receives a drive force from a not-shown drive mechanism and starts to rotate. The charging charger 5 uniformly charges the photoconductive surface of the photoconductive drum 3 to about −600 V. The exposure device 7 irradiates a light corresponding to an image to be formed to the photoconductive drum 3 uniformly charged by the charging charger 5, and forms an electrostatic latent image on the photoconductive surface. The developing device 9 develops the electrostatic latent image with the developer to form a yellow developer image.

When the yellow toner image formed on the photoconductive drum 3 reaches the primary transfer area T1 formed of the photoconductive drum 3, the intermediate transfer belt 11 and the transfer member 23, a bias voltage of about +1000 V is applied to the transfer member 23. A transfer electric field is formed between the transfer member 23 and the photoconductive drum 3, and the yellow developer image on the photoconductive drum 3 is transferred onto the intermediate transfer belt 11 in accordance with this transfer electric field in the primary transfer area T1 where it comes in contact with the intermediate transfer belt 11. The yellow toner remaining on the photoconductor after the primary transfer is subjected to development simultaneous cleaning by the yellow developing device during the period when the yellow developing device 9Y is opposite to the photoconductor.

When the development by the yellow developing device is ended, the development roller of the magenta developing device 9M is rotated so as to be opposite to the photoconductive drum 3, the black developing device also becomes opposite to the photoconductor before the timing when the magenta toner image is developed, and the yellow toner remaining on the photoconductor is electrostatically collected into the black developing device. The black developing device 9Bk is separated from the photoconductor at the timing when the residual transfer yellow toner disappears.

As stated above, when the yellow developing device 9Y (first developing device) is changed to the magenta developing device 9M (second developing device) in the rotation development unit, based on the instruction from the CPU 801, the black developing device 9Bk (corresponding to the collection unit) in the embodiment can change a mode between a "collection mode" in which it comes in contact with the photoconductive drum 3 at a specified collection position (development position of the black developing device 9Bk) to collect the toner remaining on the photoconductive drum 3 and a "non-collection mode" in which the toner collection from the photoconductive drum 3 is not performed.

Figure 3:
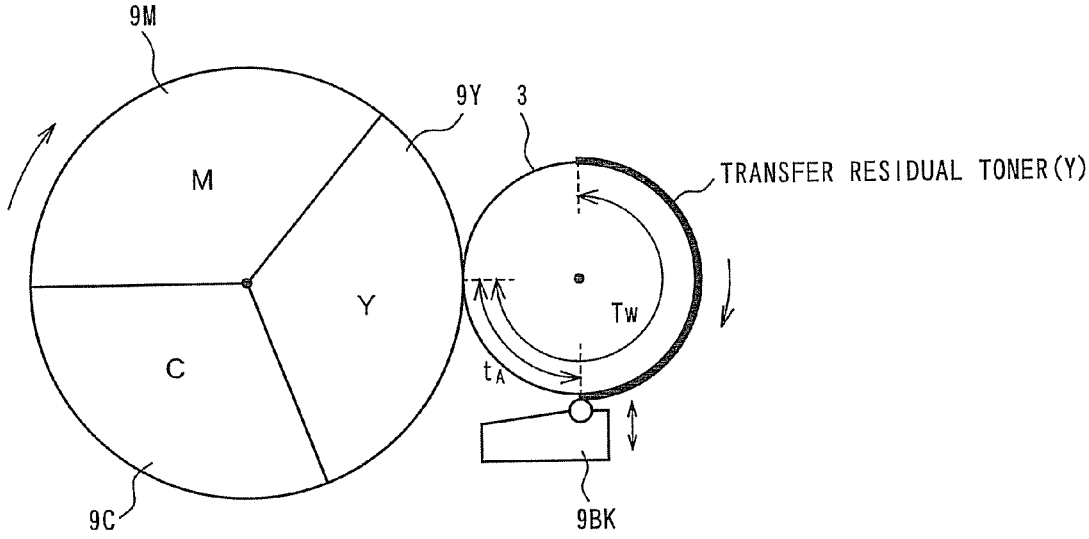
FIG. 3 is a view for explaining toner collection timing of a collection unit.
Figure 4:
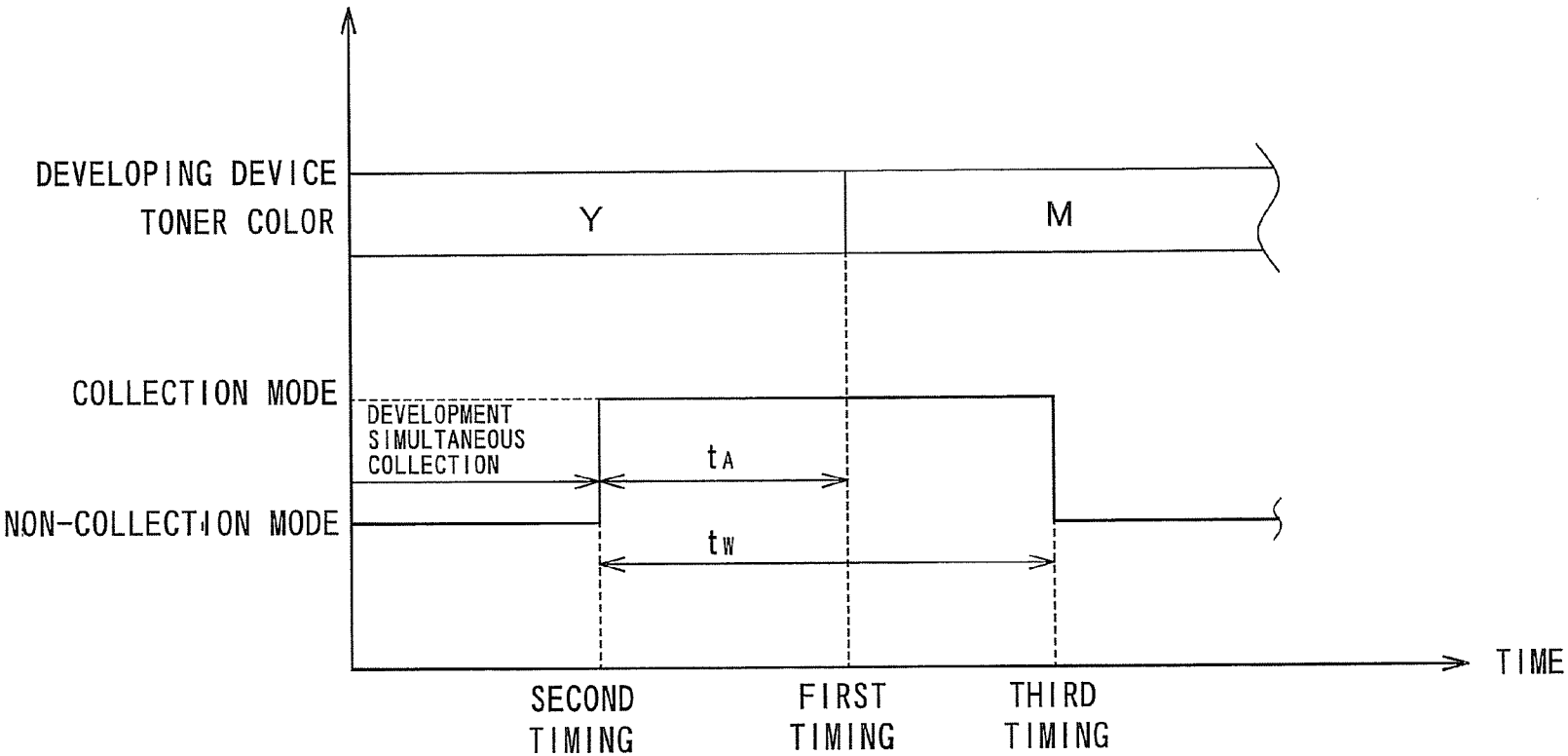
FIG. 4 is a view for explaining the toner collection timing of the collection unit.

At this time, as shown in FIG. 3 and FIG. 4, the CPU 801 sets the black developing device 9Bk into the "collection mode" only in a specified period within a period $t_W$ from a "second timing" earlier than a "first timing" when the yellow developing device 9Y is changed to the magenta developing device 9M by a time $t_A$ required for the photoconductive surface of the photoconductive drum 3 to move from the specified collection position (second development position of the black developing device 9Bk) to the specified development position (position where the photoconductive drum is developed by the developing device of the rotation development unit) to a "third timing" when the rear end of an area where the toner image is formed by the yellow developing device 9Y before the magenta developing device 9M on the photoconductive drum 3 reaches the specified collection position. That is, the collection of the transfer residual toner on the photoconductive drum 3 is performed by the black developing device 9Bk only in the period $t_W$, and in a period before the period $t_W$, the development simultaneous collection is performed by the yellow developing device 9Y so that the transfer residual toner on the photoconductive drum 3 is collected.

Next, advance is made to the development processing of the magenta toner, and the magenta toner image is transferred onto the intermediate transfer belt 11 in the primary transfer area T1. The residual transfer toner of the magenta toner is subjected to the simultaneous collection development by the magenta developing device. Similarly to the time when the yellow developing device 9Y is changed to the magenta developing device 9M, the collection of the transfer residual toner on the photoconductive drum 3 by the black developing device 9Bk is started at the second timing, and the transfer residual magenta toner is electrostatically collected until the third timing when the residual transfer magenta toner disappears. Hereinafter, also in the cyan toner image forming process, the toner collection processing by the black developing device 9Bk is performed similarly. As described above, at the time of development of a certain color, there is a delay time equivalent to one cycle of the photoconductor until the residual transfer toner of the color returns to the developing device. Accordingly, it is the point that the residual transfer toner of the former color is collected into the black developing device so that it does not enter the developing device of a next color when the developing device starts the development of the next color.

In this embodiment, the black developing device is provided independently of the color developing device. The black developing device is a contact non-magnetic one-component developing device, and at the time of residual transfer toner collection of color toner, a bias voltage of (+)300 V is applied and the color toner is collected. At the time of BK development, a normal voltage of (−)350 V is applied, and the development simultaneous cleaning of the cleanerless process is performed. After the color toner image is formed, the black toner image is subsequently formed. At the time of the black toner image forming process, the simultaneous collection development of the residual transfer black toner is performed by the black developing device.

When the toner images of the four colors are formed on the intermediate transfer belt 11, next, at the timing when the toner images reach the secondary transfer area T2 where the intermediate transfer belt and the secondary transfer roller are opposite to each other, the resister roller pair 29 supplies the sheet P, which has been previously picked up by the pickup roller and has been transported to the resister roller pair 29, to the secondary transfer area T2.

At this time, the secondary transfer roller comes in contact with the intermediate transfer belt and is applied a DC bias voltage of about (+)2000 V. The toner images are transferred onto the sheet P by the transfer electric field formed by this bias. The collectively transferred developer images as stated above are fixed on the sheet P by the fixing unit 33, and the color image is formed. The sheet P already fixed is discharged onto the paper discharge tray 34.

The secondary transfer roller is separated after the transfer. The residual toner on the intermediate transfer belt 11 after the end of the secondary transfer is collected by an intermediate transfer belt cleaner 10. The waste toner collected by the intermediate transfer belt cleaner 10 is transported to the black developing device by a not-shown transport unit and is reused.

By adopting the structure of this embodiment, when the first developing device is changed to the second developing device, the toner remaining on the photoconductive drum 3 in the image formation processing of the first developing device can be prevented from being mixed into the second developing device which has been changed and moved to the specified development position. Besides, when a structure is made such that among toners remaining on the photoconductive drum 3 in the image formation processing of the first developing device, only the toner which has a possibility of being mixed into the second developing device is collected by the collection unit, the amount of the transfer residual toner collected by the collection unit can be suppressed to the minimum. That is, it is possible to avoid such a state that the collection unit overflows with the collected transfer residual toner.

Incidentally, in this embodiment, the structure is such that by the CPU 801, the black developing device 9Bk is set into the "collection mode" in all the period $t_W$ from the second timing to the third timing. By this, among toners remaining on the image bearing body in the image formation processing of the first developing device, all toners having a possibility of being mixed into the second developing device can be collected by the collection unit, and this can contribute to a further improvement in picture quality. Of course, no limitation is made to this, and the black developing device 9Bk is set into the collection mode only in a specified period within the period from the second timing to the third timing, and the toner collection may be performed especially only in an area having a high possibility that the transfer residual toner exists on the photoconductive drum 3 (for example, especially an area where the printing ratio is high in the development processing performed just before).

Figure 5:
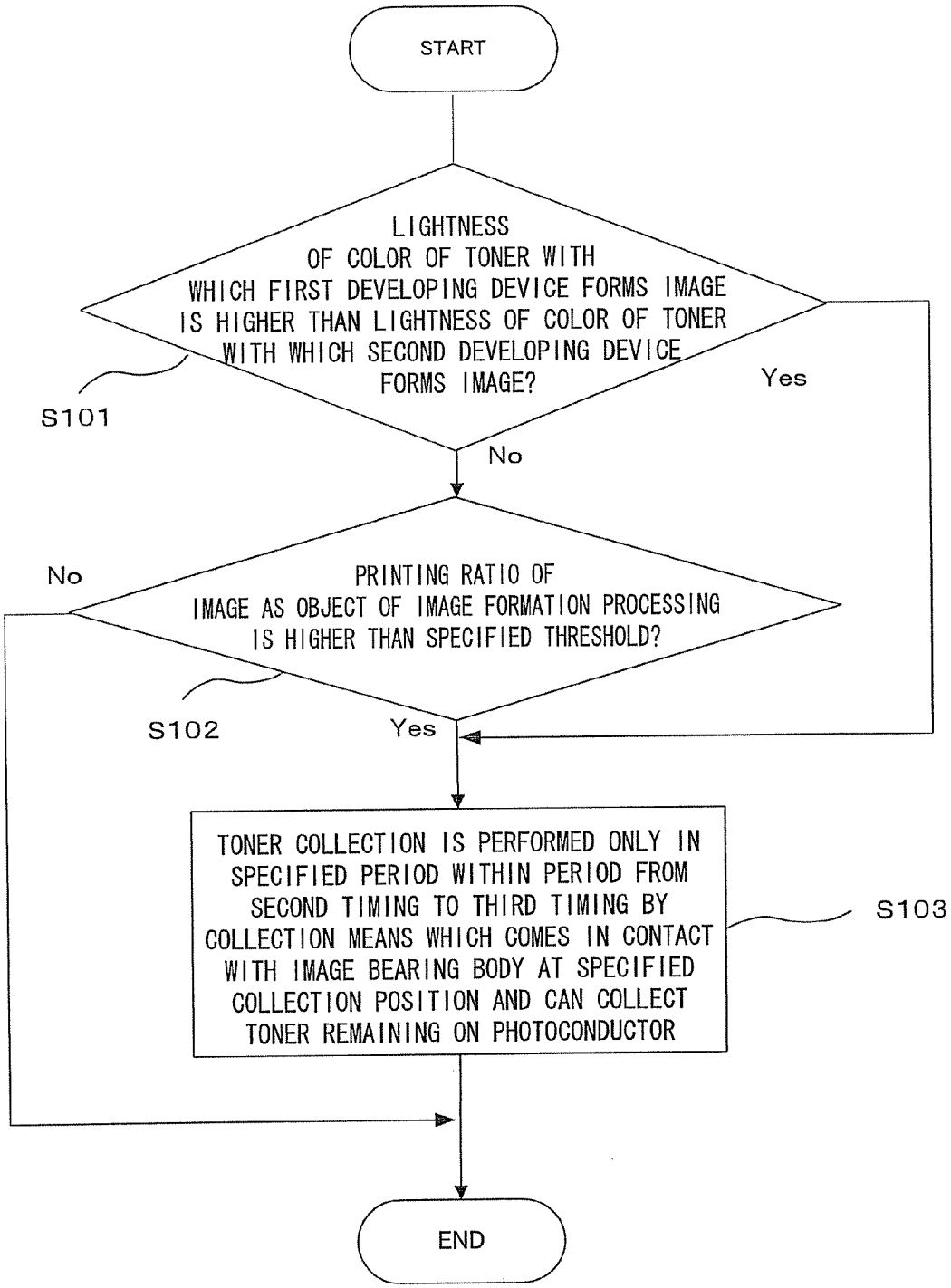
FIG. 5 is a flowchart for explaining the flow of a processing (toner collection method) in the image forming apparatus according to the embodiment.

FIG. 5 is a flowchart for explaining the flow of a processing (toner collection method) in the image forming apparatus of the embodiment.

First, the CPU 801 determines whether or not the lightness of color of toner with which the first developing device forms an image is higher than the lightness of color of toner with which the second developing device forms an image (S101).

In the case where the lightness of the color of the toner with which the first developing device forms the image is lower than the lightness of the color of the toner with which the second developing device forms the image (S101, No), the CPU 801 determines whether or not the printing ratio of the image as the object of the image formation processing in the image forming apparatus is higher than a specified threshold (S102).

In the case where the lightness of the color of the toner with which the first developing device forms the image is higher than the lightness of the color of the toner with which the second developing device forms the image (S101, Yes) or in the case where the printing ratio of the image as the object of the image formation processing is higher than the specified threshold (S102, Yes), the CPU 801 causes the black developing device 9Bk to perform the toner collection only in a specified period of the period $t_W$ from the "second timing" earlier than the "first timing" by the time for the image bearing surface of the image bearing body to move from the specified collection position to the specified development position to the "third timing" when the rear end of the area where the toner image is formed by the first developing device before the second developing device on the image bearing body reaches the specified collection position (S103).

Incidentally, the control of the collection unit by the CPU 801 as described above may be performed such that the operation timing of the collection unit is calculated each time the CPU 801 controls the collection unit, or may be performed on the basis of a time table obtained based on the specified rotation speeds of the rotation development unit and the photoconductive drum. In the case where the processing of the collection unit is performed on the basis of the specified time table, the time table is stored in a storage area readable by the CPU 801, such as, for example, the MEMORY 802.

By adopting the structure as stated above, it is possible to effectively prevent the mixture of the transfer residual toner into the second developing device in the case where the change of color of the toner is noticeable at the time when the transfer residual toner is mixed (for example, in the case where the first developing device uses the black toner and the second developing device uses the yellow toner), and this can contribute to the improvement in picture quality.

Besides, in the case where the printing ratio of the image as the object of the image processing is high, the amount of transfer residual toner remaining on the image bearing body is also liable to become large, and therefore, in the case where an image exceeding the specified printing ratio is formed, the change to the collection mode by the control unit is executed, so that the mixture of the transfer residual toner into the second developing device can be effectively prevented.

Besides, the change of the operation mode of the collection unit by the control unit is not performed each time the first developing device is changed to the second developing device, and when the change to the collection mode is performed only in the case where a specified condition as stated above is satisfied, the amount of accumulation of the transfer residual toner into the collection unit can be suppressed, and as a result, the life of the collection unit can be increased.

The respective steps (S101 to S103) of the processing in the image forming apparatus 1 are realized by causing the CPU 801 to execute the toner collection program stored in the MEMORY 802.

Incidentally, according to this embodiment, in the case where the developing devices of the color toners of cyan, magenta and yellow are held in the rotation development unit, the transfer residual toners on the image bearing body after the development processings of these developing devices are subjected to the development simultaneous collection by the black developing device, and a mixture of the transfer residual toners of the respective colors is reused as the black toner, so that a reduction in waste toner generation amount and an increase in efficiency of toner recycle can be realized.

Second Embodiment

Next, a second embodiment of the invention will be described.

Since this embodiment is a modified example of the first embodiment, a portion having the same function as a portion already described in the first embodiment is denoted by the same symbol, and its explanation will be omitted. This embodiment is different from the first embodiment in the structure of a developing device and a collection method of transfer residual toner on a photoconductive drum.

Figure 6:
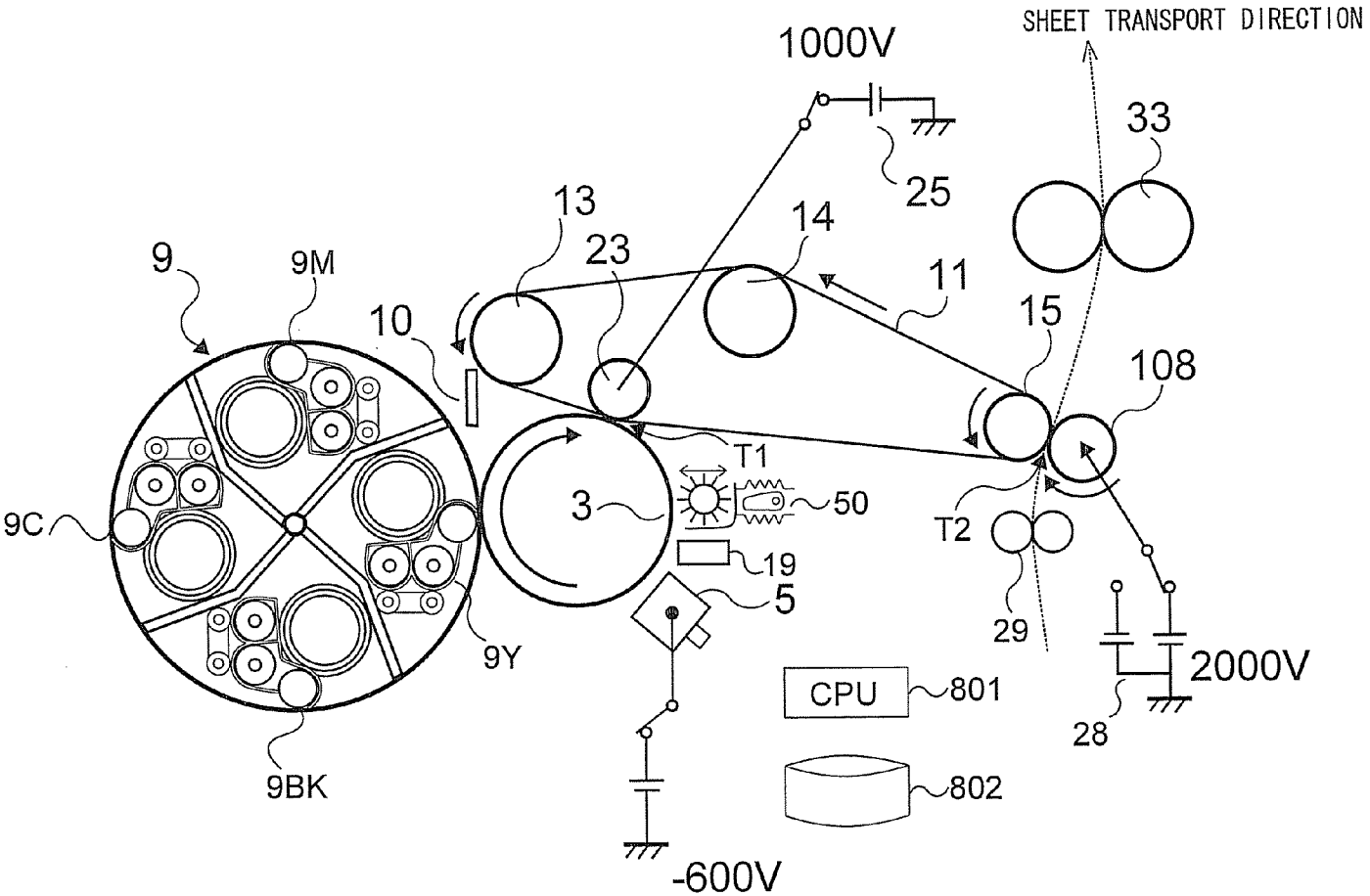
FIG. 6 is a view showing the details of a structure around a process unit in an image forming apparatus according to an embodiment.

FIG. 6 is a view showing the details of a structure around a process unit in an image forming apparatus according to this embodiment. As shown in the drawing, in this embodiment, all developing devices of cyan, magenta, yellow and black are incorporated in a rotation development unit.

In this embodiment, toner images formed on a photoconductive drum 3 are respectively transferred onto an intermediate transfer belt 11, and the toner images are collectively transferred onto a sheet P transported to a secondary transfer part. Thereafter, the sheet P is transported to a fixing unit, the images are fixed, and the sheet is discharged onto a paper discharge tray. The rotation development unit is rotatable with respect to the photoconductive drum 3, and a development roller of each of the developing devices can be rotated to a position opposite to the photoconductor and can be changed. Here, the development process of a black developing device 9Bk is performed similarly to the development process of another color developing device.

Besides, in the image forming apparatus according to this embodiment, a collection unit 50 for collecting transfer residual toner remaining on the photoconductive drum 3 is disposed. After primary transfer in a primary transfer area T1, the transfer residual toner remaining on the photoconductive drum 3 is collected by the collection unit 50.

Next, the details of the collection unit 50 will be described.

The collection unit 50 in this embodiment includes a brush roller (rotation brush) for electrically collecting the toner on the photoconductive drum 3, temporarily holds the toner collected from the photoconductive drum 3 on the brush roller, and returns the toner onto the photoconductive drum 3 at a specified timing.

The brush roller of the collection unit 50 here can come in contact with and be separated from the photoconductive drum 3 at a specified timing based on the instruction from a CPU 801 and by a contact and separation mechanism of a cam or the like operated by an electromagnetic clutch. The development toner image of each color is transferred in the primary transfer area T1, and then, the developing device is changed, and in accordance with the timing when the toner remaining on the photoconductor as the residual transfer toner is collected into the changed developing device, and actually, at the timing when the residual transfer toner is not collected into the changed developing device, the collection unit 50 performs the contact of the brush roller, and the residual transfer toner is collected in the contact part. At this time, a bias of (+)300 V is applied to the brush roller. The brush roller is rotated in the same direction (with) as the photoconductive drum, and the speed is set to be twice as fast as the photoconductive drum.

When the black developing device 9Bk is opposite to the photoconductive drum 3 and performs the development processing with the black toner, the collection unit 50 performs an operation to discharge the collected toner from the brush roller. When the toner is discharged from the collection unit 50, a bias of (−)600 V is applied to the brush roller. Alternatively, biases of (+)300 V and (−)600 V may be alternately repeatedly applied.

By this, the collected toner is discharged from the brush and is collected in the black developing device 9Bk. In this embodiment, although the toner discharge from the collection brush is performed at the time of development with the black toner, an independent control as a "discharge mode" is provided, and the discharge operation can also be performed at the time of non-printing.

Further, in the image forming apparatus including an intermediate transfer belt cleaning device, the transfer residual toner on the photoconductive drum collected in the collection unit is discharged onto the photoconductive drum at the time of non-printing, and can also be collected by the belt cleaning device.

As stated above, it is desirable that the toner collected from the photoconductive drum 3 in the collection unit 50 is transported to the developing device forming the image with the black toner by using the photoconductive drum 3, the intermediate transfer belt 11, the secondary transfer roller 108, a not-shown auger for toner transport and the like (these correspond to the transport unit).

By adopting the structure as stated above, for example, the transfer residual toner collected in the collection unit is returned onto the image bearing body at the time of non-image formation (time of non-printing) in the image forming apparatus, and the toner again attached to the image bearing body is electrically collected by the developing device, so that the waste toner-less toner recycle can be realized.

Third Embodiment

Next, a third embodiment of the invention will be described.

Since this embodiment is a modified example of the first embodiment, a portion having the same function as a portion already described in the second embodiment is denoted by the same symbol, and its explanation will be omitted. This embodiment is different from the second embodiment in a collection method of residual transfer toner on a photoconductive drum.

Figure 7:
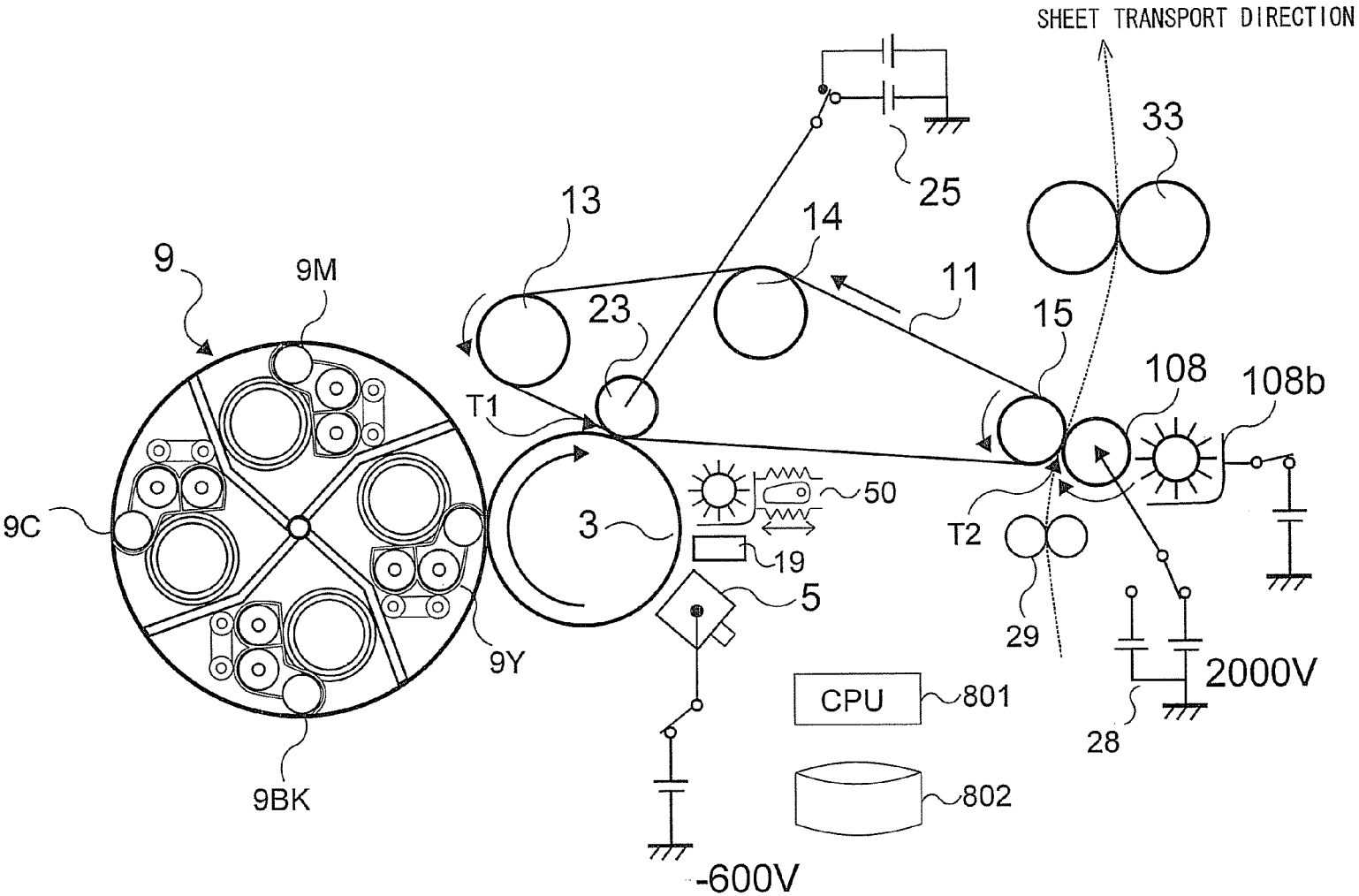
FIG. 7 is a view showing a detailed structure around a process unit of an image forming apparatus according to a third embodiment of the invention.

FIG. 7 is a view showing a detailed structure around a process unit in an image forming apparatus according to the third embodiment.

In the case where an intermediate transfer belt is a belt with low durability, such as an elastic rubber belt, it is desirable that as in this embodiment, a belt cleaning device is not provided in order to protect the intermediate transfer belt, and a cleaning device 108*b* to remove toner on a roller surface of a secondary transfer roller is provided, and toner on the belt is collected.

In this case, the secondary transfer residual toner on the intermediate transfer belt 11 is reversely transferred onto the photoconductive drum 3 and may be collected by a collection unit 50, or the toner is transferred onto the secondary transfer roller and may be collected by the cleaning device 108*b*.

The residual transfer toner collected by the cleaning device 108*b* in this way is transported to a black developing device 9Bk by a transport unit similarly to the second embodiment, is mixed with the black toner and is recycled. Incidentally, in the case where the toner collection is performed in the collection unit 50, similarly to the second embodiment, the toner is discharged at the time of development processing of the black developing device, and the development simultaneous collection of the transfer residual toner is performed by the black developing device.

Fourth Embodiment

Next, a fourth embodiment of the invention will be described.

Since this embodiment is a modified example of the first embodiment, a portion having the same function as a portion already described in the first embodiment is denoted by the same symbol, and its explanation will be omitted. This embodiment is different from the first embodiment in a collection method of transfer residual toner on a photoconductive drum. In this embodiment, similarly to the third embodiment, a cleaning device 108*b* to remove toner on a roller surface of a secondary transfer roller is provided.

Figure 8:
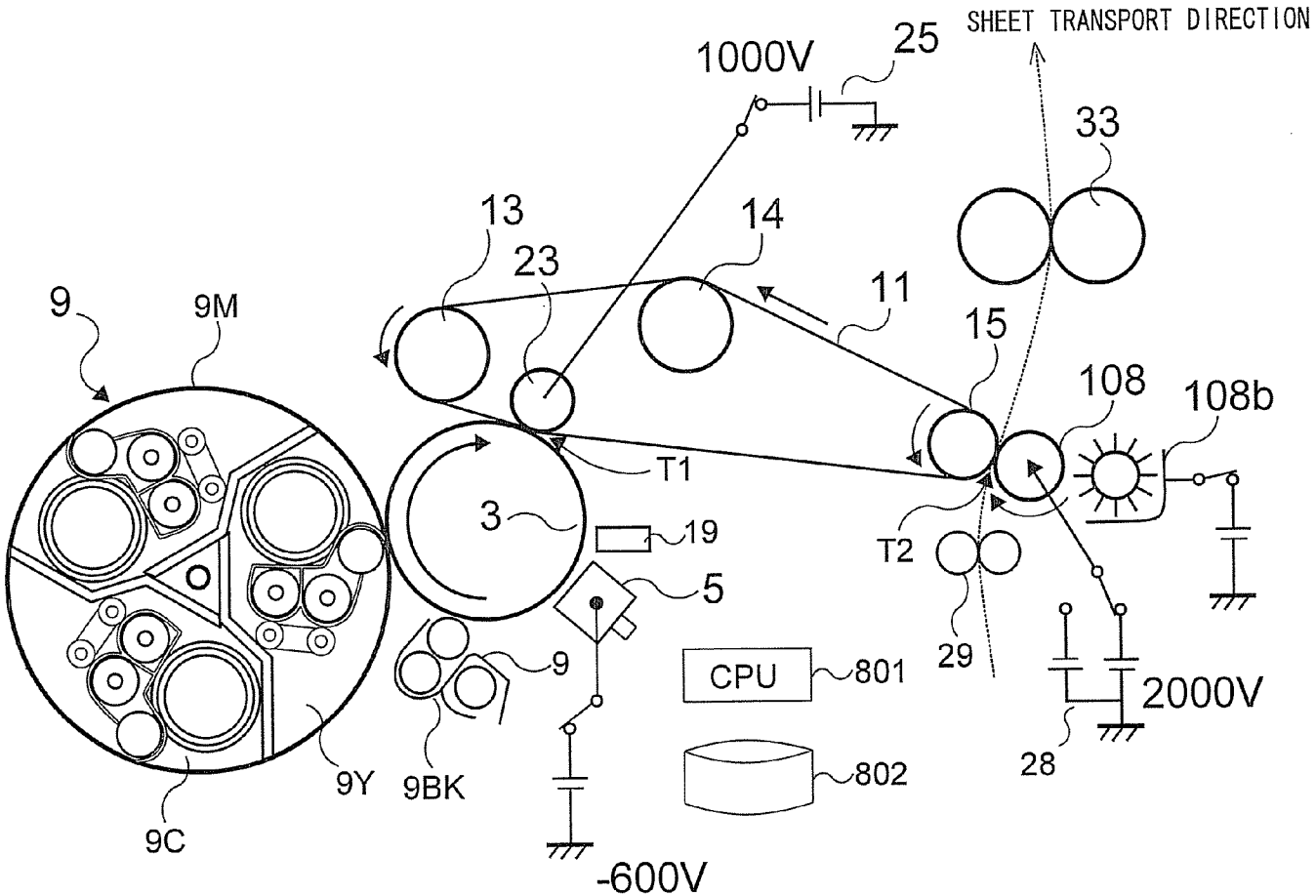
FIG. 8 is a view showing a structure around a process unit of an image forming apparatus according to a fourth embodiment.

FIG. 8 is a view showing a structure around a process unit in an image forming apparatus according to the fourth embodiment of the invention. In this embodiment, transfer residual toner on a photoconductive drum 3 is transferred onto an intermediate transfer belt 11, the toner on the intermediate transfer belt 11 is temporarily collected by the cleaning device 108*b*, is returned to the intermediate transfer belt 11 at a specified timing, and is collected by a black developing device 9Bk through the photoconductive drum 3.

Fifth Embodiment

Next, a fifth embodiment of the invention will be described.

Since this embodiment is a modified example of the second embodiment, a portion having the same function as a portion already described in the second embodiment is denoted by the same symbol, and its explanation will be omitted. This embodiment is different from the second embodiment in a charging system of a photoconductive drum.

Figure 9:
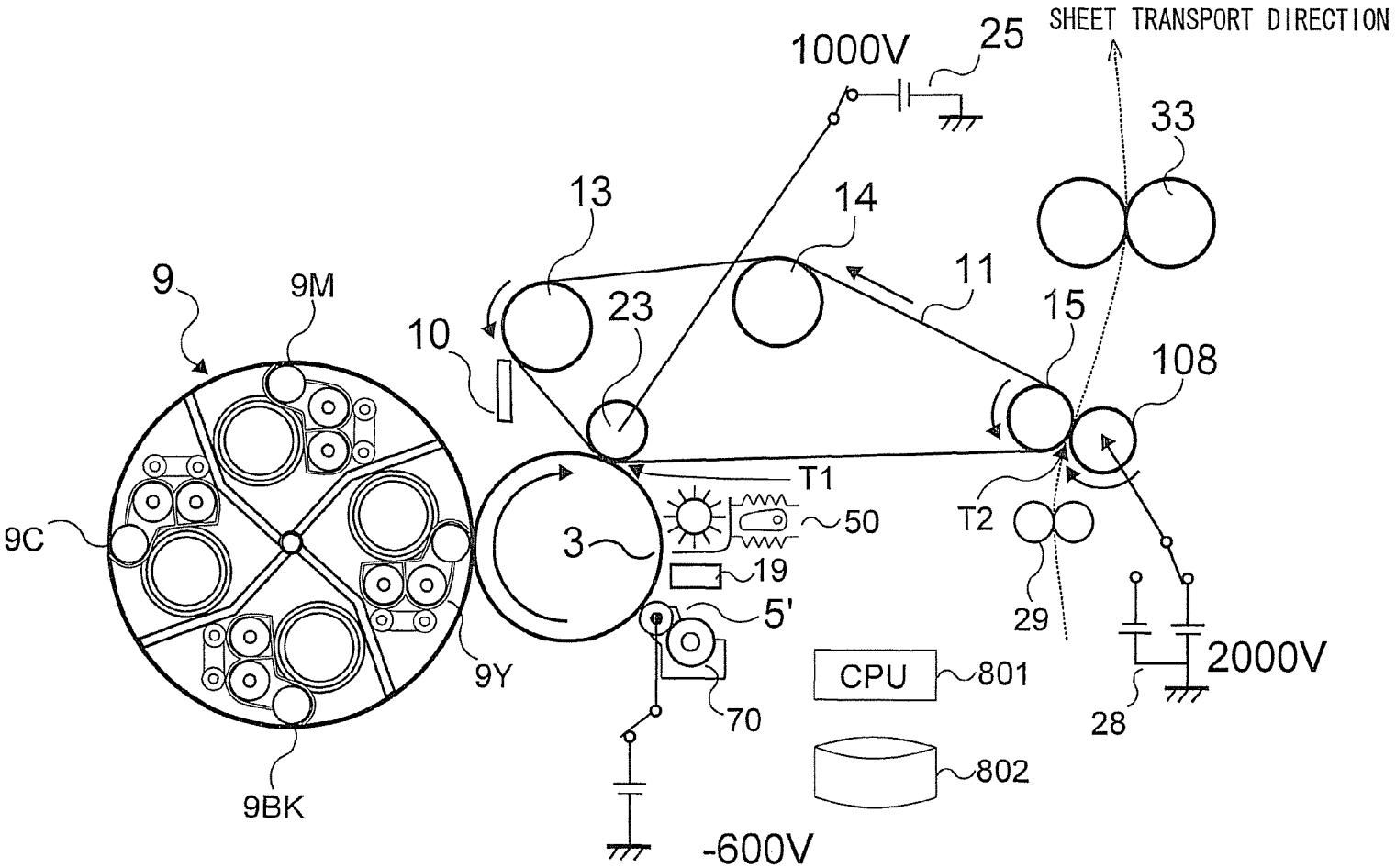
FIG. 9 is a view showing a structure around a process unit of an image forming apparatus according to a fifth embodiment.

FIG. 9 is a view showing a structure around a process unit in the fifth embodiment of the invention.

As shown in the drawing, in this embodiment, the charging system of a photoconductive drum 3 is a contact charging system, and includes a charger 5' in which a conductive rubber roller is brought into contact with the photoconductive drum 3. The charger 5' includes a cleaning device 70 to clean toner attached on the surface of the conductive rubber roller.

The cleaning device 70 includes, for example, a conductive rubber roller, and a positive (+) bias voltage is applied thereto. Further, a blade for cleaning is in contact with the conductive rubber roller, and peels off the collected toner on the conductive rubber roller. The toner collected in this way is transported to a black developing device 9Bk by a transport unit similarly to the second embodiment, and is mixed with black toner and is recycled.

Incidentally, in the foregoing respective embodiments, although the example has been described in which the cleaning means for collecting the toner attached to the intermediate transfer belt or the secondary transfer roller is provided, no limitation is made to this. For example, in an image forming apparatus of a complete cleanerless process in which a cleaner is not provided for either the intermediate transfer belt or the secondary transfer roller, the toner collected by the secondary transfer roller is returned to the intermediate transfer belt, and the toner transferred on the intermediate transfer belt may be returned onto the photoconductive drum. Also in this case, similarly, the toner returned onto the photoconductive drum is collected in the collection unit.

Besides, in the foregoing respective embodiments, although the example has been described in which the intermediate transfer belt is adopted as the intermediate transfer body onto which the toner image formed on the photoconductive drum is temporarily transferred, no limitation is made to this, and as long as an image forming process similar to that of the intermediate transfer belt can be realized, an intermediate transfer roller or the like can also be adopted.

Besides, in the foregoing respective embodiments, although the structure has been described in which the respective developing devices of yellow, magenta, and cyan are moved while being rotated with respect to the development position of the photoconductive drum, no limitation is made to this, and the respective developing devices are arranged along the rotation direction of the photoconductive drum (movement direction of the photoconductive surface of the photoconductive drum), and the respective developing devices may be freely advanced to and retreated from the surface of the photoconductive drum by using a cam mechanism or the like.

In this embodiment, although the description has been made to the case where the functions to carry out the invention are previously recorded in the inside of the apparatus, no limitation is made to this, and similar functions may be downloaded from a network, or a recording medium storing similar functions may be installed in the apparatus. As the recording medium, any form may be adopted as long as a program can be stored and can be read by the apparatus, such as a CD-ROM. Besides, the functions obtained by the previous installation or download may realize the functions by cooperation with an OS (Operating System) in the inside of the apparatus.

By adopting the structure as described above, the collection place of the waste toner collected from the photoconductive drum is limited to one place such as the black developing device, and therefore, contribution can be made to miniaturization of the apparatus and improvement in maintenance property.

Although the invention has been described by use of the specific embodiments, it would be apparent for one of ordinary skill in the art that various modifications and improvements can be made without departing from the sprit and scope of the invention.

As described above in detail, according to the invention, it is possible to provide the technique in which in the image forming apparatus of the four-rotation intermediate transfer system, even in a state where a large amount of transfer residual toner is generated, the occurrence of color mixture of toners can be effectively suppressed.

What is claimed is:

1. An image forming apparatus of a cleanerless process in which a toner image is formed on an image bearing body by a developing device and a toner remaining on the image bearing body is collected by the developing device, the image forming apparatus comprising:

a development unit to rotatably hold plural developing devices including a first developing device and a second developing device to form images with toners of colors different from each other and to move a desired developing device to a specified development position opposite to the image bearing body by the rotational movement;

a change unit configured to change a mode between a collection mode of collecting the toner remaining on the image bearing body at a specified collection position of the image bearing body and a non-collection mode of not performing toner collection from the image bearing body; and a control unit to set, when the first developing device is changed to the second developing device in the development unit, the collection unit into the collection mode only in a specified period within a period from a second timing earlier than a first timing when the first developing device is changed to the second developing device by a time required for an image bearing surface of the image bearing body to move from the specified collection position to the specified development position to a third timing when a rear end of an area where the toner image is formed by the first developing device before the second developing device on the image bearing body reaches the specified collection position.

2. The image forming apparatus according to claim 1, wherein the control unit sets the collection unit into the collection mode in all the period from the second timing to the third timing.

3. The image forming apparatus according to claim 1, wherein, in a case where lightness of color of the toner with which the first developing device forms the image is higher than lightness of color of the toner with which the second developing device forms the image, the control unit sets the collection unit into the collection mode only in the specified period within the period from the second timing to the third timing.

4. The image forming apparatus according to claim 1, wherein, in a case where a printing ratio of an image as an object of an image formation processing in the image forming apparatus is higher than a specified threshold, the control unit sets the collection unit into the collection mode only in the specified period within the period from the second timing to the third timing.

5. The image forming apparatus according to claim 1, wherein the collection unit includes a brush roller to electrically collect the toner on the image bearing body, temporarily holds the toner collected from the image bearing body on the brush roller, and returns the toner onto the image bearing body at a specified timing.

6. An image forming apparatus of a cleanerless process in which a toner image is formed on an image bearing body by a developing device and a toner remaining on the image bearing body is collected by the developing device, the image forming apparatus comprising:

a development unit to movably hold plural developing devices to form images with toners of colors different from each other and to move a desired developing device to a specified development position opposite to the image bearing body by the movement;

a collection unit capable of changing a mode between a collection mode of collecting the toner remaining on the image bearing body at a specified collection position of the image bearing body and a non-collection mode of not performing toner collection from the image bearing body;

a control unit to set, when a first developing device is changed to a second developing device in the development unit, the collection unit into the collection mode only in a specified period within a period from a second timing earlier than a first timing when the first developing device is changed to the second developing device by a time required for an image bearing surface of the image bearing body to move from the specified collection position to the specified development position to a third timing when a rear end of an area where the toner image is formed by the first developing device before the second developing device on the image bearing body reaches the specified collection position; and a black development unit to hold, in a vicinity of a second development position opposite to the image bearing body, a black developing device to be contactable to and separable from the second development position of the image bearing body, the collection unit is the black developing device held in the black development unit.

7. The image forming apparatus according to claim 1, further comprising a transport unit to transport the toner collected from the image bearing body by the collection unit to the developing device that forms an image with a black toner.

8. The image forming apparatus according to claim 1, wherein the image bearing body and at least one of the collection unit and the development unit are integrally supported as a process unit and are attachable to and detachable from the image forming apparatus.

9. An image forming apparatus of a cleanerless process in which a toner image is formed on an image bearing body by a developing device and a toner remaining on the image bearing body is collected by the developing device, the image forming apparatus comprising:

a development unit to rotatably hold plural developing devices including a first developing device and a second developing device to form images with toners of colors different from each other and to move a desired developing device to a specified development position opposite to the image bearing body by the rotational movement;

collection means capable of changing a mode between a collection mode of collecting the toner remaining on the image bearing body at a specified collection position of the image bearing body and a non-collection mode of not performing toner collection from the image bearing body; and control means for setting, when the first developing device is changed to the second developing device in the development unit, the collection means into the collection mode only in a specified period within a period from a second timing earlier than a first timing when the first developing device is changed to the second developing device by a time required for an image bearing surface of the image bearing body to move from the specified collection position to the specified development position to a third timing when a rear end of an area where the toner image is formed by the first developing device before the second developing device on the image bearing body reaches the specified collection position.

10. The image forming apparatus according to claim 9, wherein the control means sets the collection means into the collection mode in all the period from the second timing to the third timing.

11. The image forming apparatus according to claim 9, wherein, in a case where lightness of color of the toner with which the first developing device forms the image is higher than lightness of color of the toner with which the second developing device forms the image, the control means sets the collection means into the collection mode only in the specified period within the period from the second timing to the third timing.

12. The image forming apparatus according to claim 9, wherein, in a case where a printing ratio of an image as an object of an image formation processing in the image forming apparatus is higher than a specified threshold, the control means sets the collection means into the collection mode only in the specified period within the period from the second timing to the third timing.

13. The image forming apparatus according to claim 9, wherein the collection means includes a brush roller to electrically collect the toner on the image bearing body, temporarily holds the toner collected from the image bearing body on the brush roller, and returns the toner onto the image bearing body at a specified timing.

14. An image forming apparatus of a cleanerless process in which a toner image is formed on an image bearing body by a developing device and a toner remaining on the image bearing body is collected by the developing device, the image forming apparatus comprising:

a development unit to movably hold plural developing devices to form images with toners of colors different from each other and to move a desired developing device to a specified development position opposite to the image bearing body by the movement;

collection means capable of changing a mode between a collection mode of collecting the toner remaining on the image bearing body at a specified collection position of the image bearing body and a non-collection mode of not performing toner collection from the image bearing body;

control means for setting, when a first developing device is changed to a second developing device in the development unit, the collection means into the collection mode only in a specified period within a period from a second timing earlier than a first timing when the first developing device is changed to the second developing device by a time required for an image bearing surface of the image bearing body to move from the specified collection position to the specified development position to a third timing when a rear end of an area where the toner image is formed by the first developing device before the second developing device on the image bearing body reaches the specified collection position; and a black development unit to hold, in a vicinity of a second development position opposite to the image bearing body, a black developing device to be contactable to and separable from the second development position of the image bearing body, the collection means is the black developing device held in the black development unit.

15. The image forming apparatus according to claim 9, further comprising transport means for transporting the toner collected from the image bearing body by the collection means to the developing device that forms an image with a black toner.

16. The image forming apparatus according to claim 9, wherein the image bearing body and at least one of the collection means and the development unit are integrally supported as a process unit and are attachable to and detachable from the image forming apparatus.

17. A toner collection method in an image forming apparatus of a cleanerless process in which a toner image is formed on an image bearing body by a developing device and a toner remaining on the image bearing body is collected by the developing device, wherein:

changing a first developing device to a second developing device in a development unit which rotatably holds the first developing device and the second developing device to form images with toners of colors different from each other and moves a desired developing device to a specified development position opposite to the image bearing body by rotational movement; and collecting a toner remaining on the image bearing body at a specified collection position of the image bearing body when the first developing device is changed to the second developing device, only in a specified period within a period from a second timing earlier than a first timing when the first developing device is changed to the second developing device by a time required for an image bearing surface of the image bearing body to move from the specified collection position to the specified development position to a third timing when a rear end of an area where the toner image is formed by the first developing device before the second developing device on the image bearing body reaches the specified collection position.

18. The toner collection method according to claim 17, wherein the toner collection is performed by the collection unit in all the period from the second timing to the third timing.

19. The toner collection method according to claim 17, wherein, in a case where lightness of color of the toner with which the first developing device forms the image is higher than lightness of color of the toner with which the second developing device forms the image, the toner collection is performed by the collection unit only in the specified period within the period from the second timing to the third timing.

20. The toner collection method according to claim 17, wherein, in a case where a printing ratio of an image as an object of an image formation processing in the image forming apparatus is higher than a specified threshold, the toner collection is performed by the collection unit only in the specified period within the period from the second timing to the third timing.

* * * * *